US006718815B2

(12) United States Patent
Fantini

(10) Patent No.: US 6,718,815 B2
(45) Date of Patent: Apr. 13, 2004

(54) CRIMPING TOOL AND DEVICE FOR FLEXIBLE CIRCUIT AND CRIMPING STATION PROVIDED WITH SUCH A DEVICE

(75) Inventor: Flavio Fantini, Puteaux (FR)

(73) Assignee: FCI, Paris (FR)

( * ) Notice: Subject to any disclaimer, the term of this patent is extended or adjusted under 35 U.S.C. 154(b) by 0 days.

(21) Appl. No.: 10/056,620

(22) Filed: Jan. 23, 2002

(65) Prior Publication Data

US 2002/0124625 A1 Sep. 12, 2002

(30) Foreign Application Priority Data

Jan. 23, 2001 (FR) ..... 01 01184

(51) Int. Cl.[7] ..... B21D 39/00; H01R 43/048

(52) U.S. Cl. ..... 72/412; 29/243.518; 29/871; 29/874; 29/882

(58) Field of Search ..... 72/412, 414; 29/749, 29/741, 882, 857, 874, 243.518, 243.517, 871

(56) References Cited

U.S. PATENT DOCUMENTS

| | | | | | |
|---|---|---|---|---|---|
| 1,677,968 | A | * | 7/1928 | Hughes | 72/412 |
| 2,064,322 | A | * | 12/1936 | Ruppert | 428/600 |
| 3,190,953 | A | * | 6/1965 | Keller | 174/262 |
| 3,299,493 | A | * | 1/1967 | Gehrt | 29/874 |
| 3,526,955 | A | * | 9/1970 | Cilione | 29/512 |
| 3,840,840 | A | * | 10/1974 | Worth | 439/399 |
| 3,924,917 | A | | 12/1975 | Munshower | 339/17 F |
| 4,027,521 | A | * | 6/1977 | McKee et al. | 72/404 |
| 4,066,319 | A | * | 1/1978 | Baker et al. | 439/422 |
| 4,414,740 | A | * | 11/1983 | Nijman | 29/751 |
| 4,543,716 | A | | 10/1985 | Damiano et al. | 29/871 |
| 4,587,725 | A | * | 5/1986 | Ogawa et al. | 29/753 |
| 4,749,368 | A | | 6/1988 | Mouissie | 439/421 |
| 4,798,070 | A | * | 1/1989 | Hlavaty | 72/88 |
| 4,831,722 | A | * | 5/1989 | Bauer et al. | 29/751 |
| 5,161,403 | A | * | 11/1992 | Kitchens | 72/414 |
| 6,477,771 | B2 | * | 11/2002 | Asakura et al. | 29/882 |

FOREIGN PATENT DOCUMENTS

EP 0243998 A1 11/1987

OTHER PUBLICATIONS

"SAE Technical Paper Series 870553 Flex–Foil Crimp Technology", B. Mouissie, International Congress And Exposition, 1987.

* cited by examiner

*Primary Examiner*—Daniel C. Crane
(74) *Attorney, Agent, or Firm*—Perman & Green, LLP

(57) ABSTRACT

Tool, device and machine for crimping contacts 10 possibly arranged in a housing of connector 20 onto a flexible circuit 40. The tool principally has a solid block 1 provided with a plurality of stamps 3 for crimping. The device has a tool support mounted in a press 9 and an anvil 50, the tool and the anvil coming to crimp the contacts mounted in the connector onto the flexible circuit.

11 Claims, 6 Drawing Sheets

CRIMPING TOOL AND DEVICE FOR FLEXIBLE CIRCUIT AND CRIMPING STATION PROVIDED WITH SUCH A DEVICE

BACKGROUND OF THE INVENTION

The invention concerns a tool and a device for crimping contacts onto flexible circuits as well as a crimping station particularly designed for the assembly and creation of bundles provided with connectors on flexible circuits.

Flexible circuits are electrical circuits having an insulating sheet on which conductive tracks are positioned, these tracks being themselves possibly covered with a second protective insulating sheet.

Such circuits are notably coupled to electrical contacts by a technique of piercing the insulation and crimping, and the use of contacts provided with a crimping end having points arranged in a crown and orientated perpendicularly to the flexible circuit to be coupled is known for this purpose. Document U.S. Pat. No. 4,749,368 notably describes the creation of contact elements and coupling of components provided with connection points arranged in a crown.

Contacts are crimped onto the flexible circuit traditionally by positioning the contacts under the flexible circuit facing the conductive tracks of the flexible circuit and then by crimping the contacts onto the flexible circuit by means of crimping matrices formed at the end of cylindrical pins mounted in a framework, a pressing device coming to apply the cylindrical pins onto the flexible circuit of the side facing the crowns, at the center of the crowns, a surface forming an anvil being positioned under the contacts in order to apply a counter-pressure. The result of the crimping operation is a piercing of the insulation by the points, the points being then bent back into petals.

The principle for using such pins, for example, is described in the document "SAE technical paper series 870553 Flex foil crimp technology—International Congress and Exposition, Detroit, Michigan, Feb. 23–27, 1987.

The diameter of the crowns is of the order of a few millimeters for the circuits and for the contacts designed to conduct currents of the order of several amperes.

For flexible circuits with a large number of tracks with, for example, an interval between the tracks of 1 to 5 mm, it is necessary to precisely mount a large number of pins in a framework that is in turn provided with holes for taking up the pins machined with a great precision, the pins having, moreover, at the level of their crimping ends, a very strict coplanarity.

Such an embodiment is costly and, even if the pins have a long service life of the order of 800,000 crimpings, risks of breakage exist and the operation of replacing a pin is complex, each of the pins being held in the framework by shafts mounted perpendicularly to the pins in the framework.

Moreover, during crimping, the pins may come into contact along an axis different from the perpendicular axis passing through the center of the crown. In this case, the crimping imprint will have irregularities in the shape of the petals and, in a particularly unfavorable case, a point may not be bent back or may remain imprisoned in the insulation, thus leading to a degradation of the electrical and mechanical crimping characteristics.

SUMMARY OF THE INVENTION

The present invention notably proposes a simplified and non-cumbersome structure of crimping matrices which permits very precisely controlling the intervals between the crimping matrices and the coplanarity of the matrices and minimizing the defects obtained during crimping by conducting a controlled simultaneous bonding of all the points.

For this object and according to a first subject, the invention is principally based on the creation of a tool for crimping electrical contact paddles onto conductive tracks of a flexible circuit, this tool having a multipoint network of crimping matrices made up of a solid block having at least one flat surface on which a network of paving blocks of polygonal section and flared base is machined, the "paving blocks" making up the matrices.

The paving blocks notably have a profile that forms a curve on each of their lateral faces a curve widening from the terminal section of the paving block toward the base of the paving block, the coupling zone between the paving block and the block.

In an advantageous manner, the block making up the multipoint matrix can have a network of paving blocks over each of two surfaces.

In a particular mode of embodiment designed for contacts provided with crimping points arranged in a crown, the terminal polygonal section of the paving blocks is oriented so that the lateral faces of the paving blocks come into contact with the crimping points during the crimping operation so as to press back the points and make them into petals.

The invention also concerns a device for simultaneous crimping onto a flexible circuit of electrical contact elements aligned in a plane.

This device is designed for the crimping of a connector provided with a plurality of contacts. In this type of connector, the contacts have, on one side, an end part for coupling to a flexible circuit, this end part having a paddle provided with points arranged in a crown, the points being made by a cross punching of the paddle and then stamping the paddle to fold back the points and open up a circular hole, forming the crown.

On the other side, the contacts have an end part for connection with a complementary contact, the contacts and the flexible circuit being taken up in an insulated housing provided with an open zone releasing the crimping zone of the contacts onto the flexible circuit above and below the crimping zone.

In order to crimp the contacts, on one side, the device has an anvil forming a lower support surface for the electrical contact elements, and on the other side, the crimping device has a mobile pressing device provided with a block whose surface parallel to the alignment plane of the contacts has a plurality of crimping matrices made up of paving blocks with a terminal polygonal section.

The anvil positioned under the paddles can have at least one positioning element and advantageously two positioning elements facing the crowns of two contacts positioned at each end of the flexible circuit, each positioning element being introduced into one of the circular holes of the crowns.

The flexible circuit is then positioned on the paddles and the block is applied by the press onto the flexible circuit, each of the matrices locally and strongly applying the flexible circuit onto the points so as to pierce the flexible circuit and then to bend the points which thus come to crimp the paddles onto the flexible circuit and to effect the electrical connection between the contacts and the tracks of the flexible circuit.

The anvil and press assembly provided with a crimping block according to the invention thus constitutes an optimized crimping device permitting a precision crimping with great reproducibility of the crimpings and making a crimping imprint which can inspected by a camera device with a minimized error rate.

The paving blocks constituting the crimping matrices will be implanted as a function of the number of contacts per connector and the number and arrangement of the crimping crowns. A device for which the paving blocks will have a different polygonal section as a function of the diameter of the crowns is, of course, possible.

BRIEF DESCRIPTION OF THE DRAWINGS

Other aspects and advantages of the invention will be better understood upon reading the description which follows of one non-limiting mode of embodiment in reference to the drawings which show.

DETAILED DESCRIPTION OF THE PREFERRED EMBODIMENTS

Figure 3:
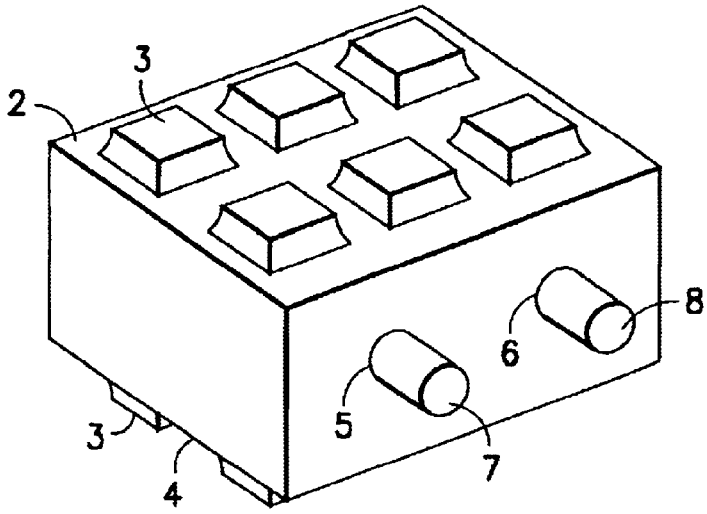
In FIG. 3: a view of a crimping device conforming to the invention.

Referring to FIG. 3, a crimping tool conforming to a first subject of the invention is shown. This tool is principally based on the creation of a multipoint network of crimping matrices made from a solid block 1.

This network can be made by an electroerosion process in order to obtain a high precision and a very smooth surface state.

Figure 4A:
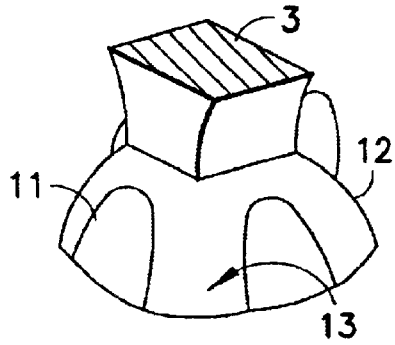
In FIG. 4A: an enlarged view of a crown according to FIG. 2 before crimping.

This network is created on a flat surface 2 of the block and the matrix network has a network of paving blocks 3 of polygonal section and flared base, the paving blocks making up the matrices. In order to bend the crimping points, as shown in FIG. 4A, the paving blocks have a profile forming a curve on each of their lateral faces broadening from the terminal section of the paving block towards the root of the paving block. The lateral faces are applied against the points and force them to form into petals.

The block making up the multipoint matrix can have a network of paving blocks on two opposite parallel surfaces 2, 4 of the block. This permits minimizing the immobilization time of the machine by reversing the block when a first network of matrices is used up.

Figure 2A:
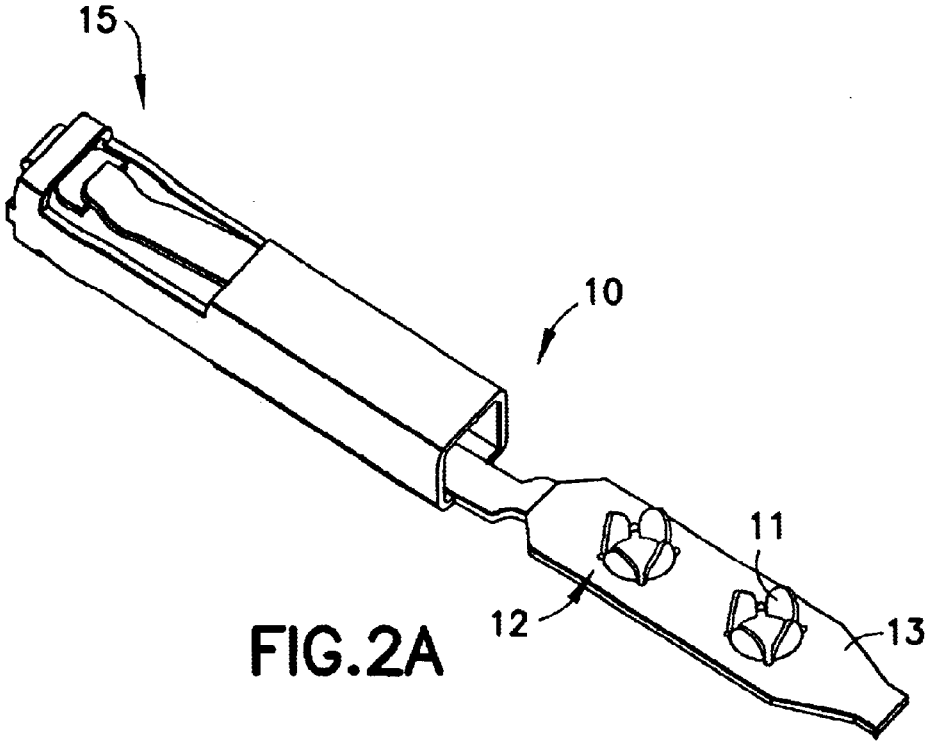
In FIGS. 2A and 2B: examples of contacts provided with crowns of points to be crimped onto the flexible circuit.
Figure 2B:
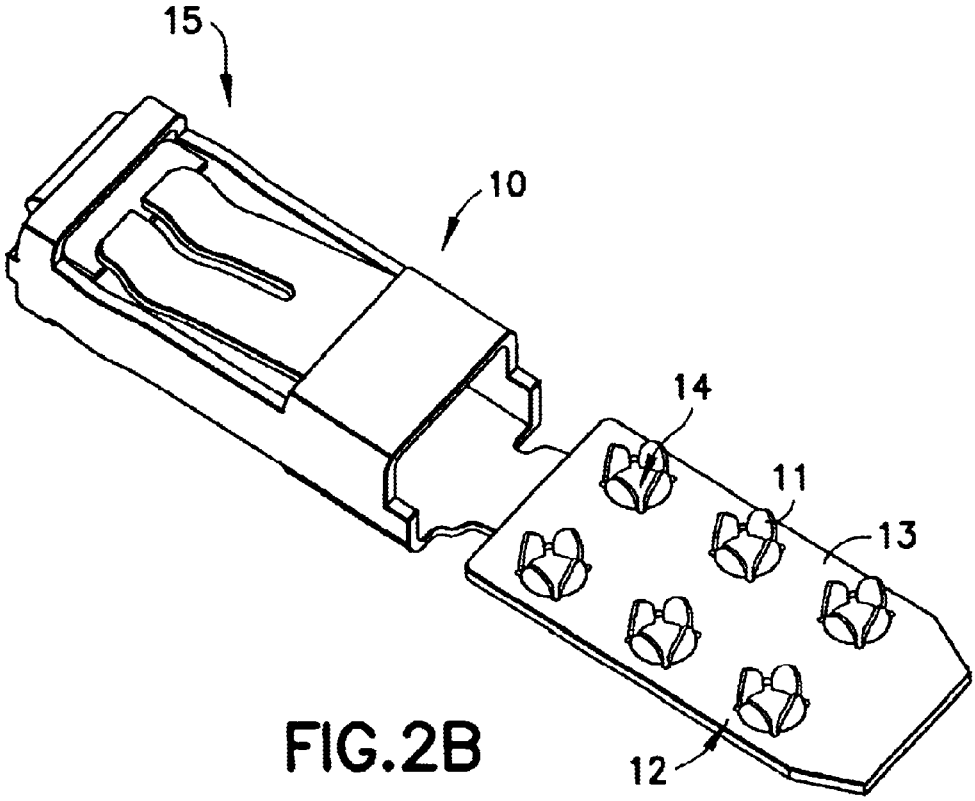

Contacts to be crimped that can be used with the paving blocks of matrices for crimping of the invention are shown in FIGS. 2A and 2B. These contacts 10 are provided with points 11 for crimping and are arranged in crowns 12.

On one side, the contacts shown have an end part for coupling to a flexible circuit 40, this end part having a paddle 13 provided with points 11 arranged in a crown 12, the points being made by cross-punching the paddle and then stamping the paddle to fold back the points and open up a circular hole 14 forming the crown 12.

On the other side, the contacts shown have an end part 15 for connection with a complementary contact. As is visible in FIG. 1, the contacts and the flexible circuit are taken up in an insulated housing 21 of a connector module 20, housing 21 being furnished with an open zone 22 that releases the zone for crimping the contact onto the flexible circuit above and below the crimping zone.

Figure 7A:
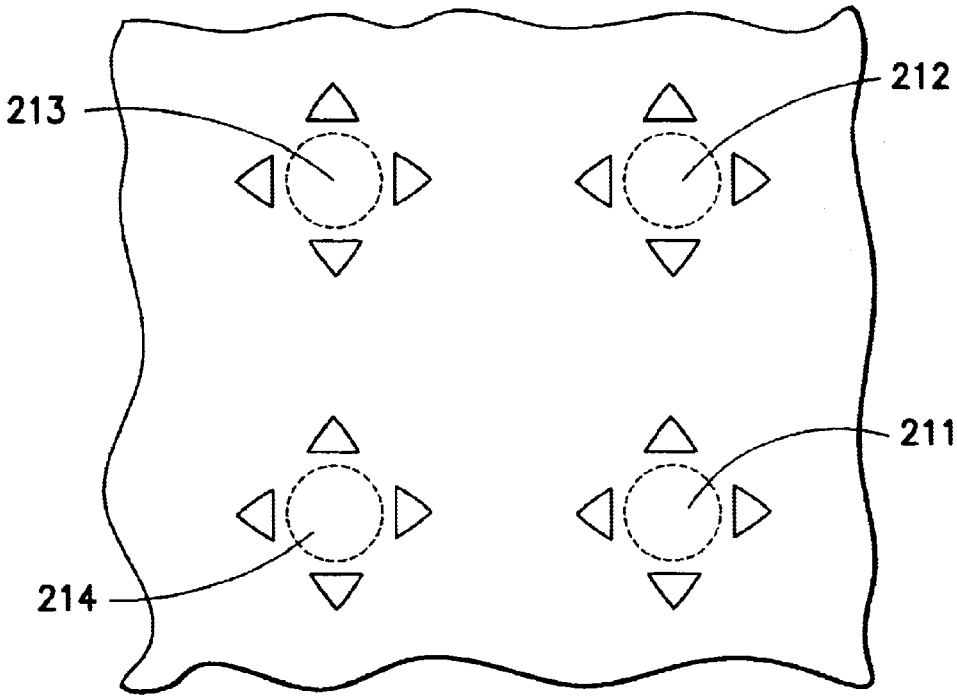
FIG.7A PRIOR ART
In FIG. 7A: a view of a flexible circuit crimped according to the prior art.
Figure 7B:
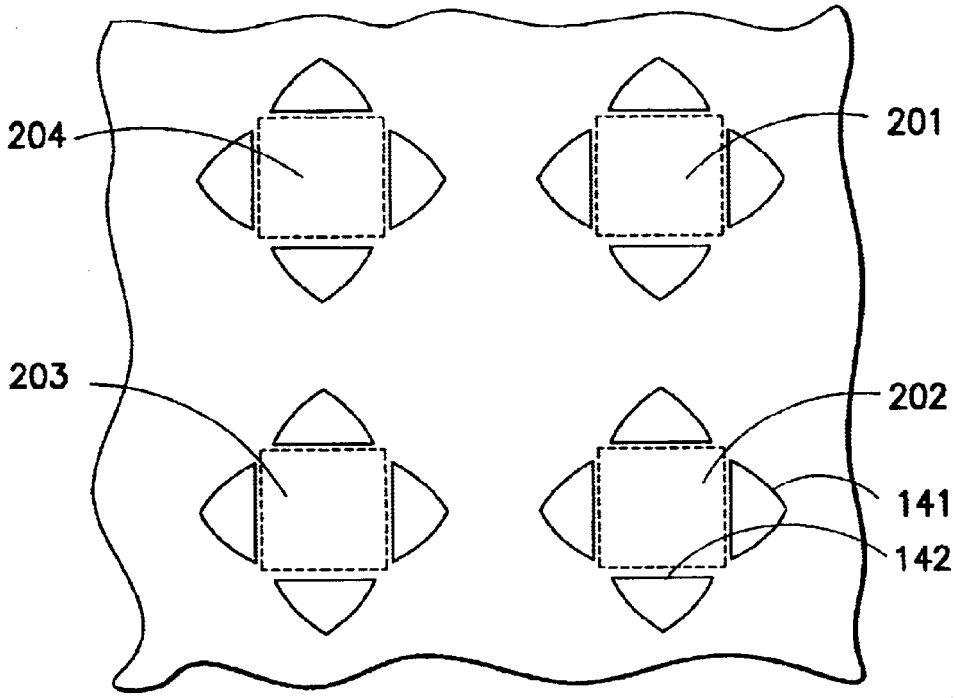
In FIG. 7B: a view of a flexible circuit crimped by the device according to the invention.

In order to crimp the contact assembly in position in connector module 20, the terminal polygonal sections of the paving blocks are oriented so that the lateral faces of the paving blocks come into contact with the crimping points during the crimping operation so as to press back the points and shape them into petals 141; the imprints of matrices 201, 202, 203 and 204 which are visible on the flexible circuit in FIG. 7B are of square section Circular imprints 211, 212, 213, 214 resulting from the application of pins of the prior art are shown in FIG. 7A. A comparison of FIGS. 7A and 7B shows the result of the application of the faces of the paving block against the points.

Due to the fact that the paving blocks are supported by their faces against the points, pressure is applied by a straight segment of the paving block against the lateral edges of the points and this leads to a flattening of the section of the points and a homogeneous deformation of the point, the contact zone being broadened along the descending shape of the paving block. In the prior art, since the pins are of the conical type, the pressure generated by the pins is applied to the contact point between the pin and the point. Since this contact point moves along the central vertical axis of the point, there is no flattening of the petal, but rather a warping of the petal and an incorrectly controlled deformation of the petal. It is seen in FIG. 7B that the petals obtained by application of paving blocks 3 have been folded more regularly and have a larger folded surface than according to the prior technique. Moreover, base 142 of the petals is straight, which facilitates measurement of the dimension and of the position of the petals by a computer-aided camera measurement device.

Figure 5:
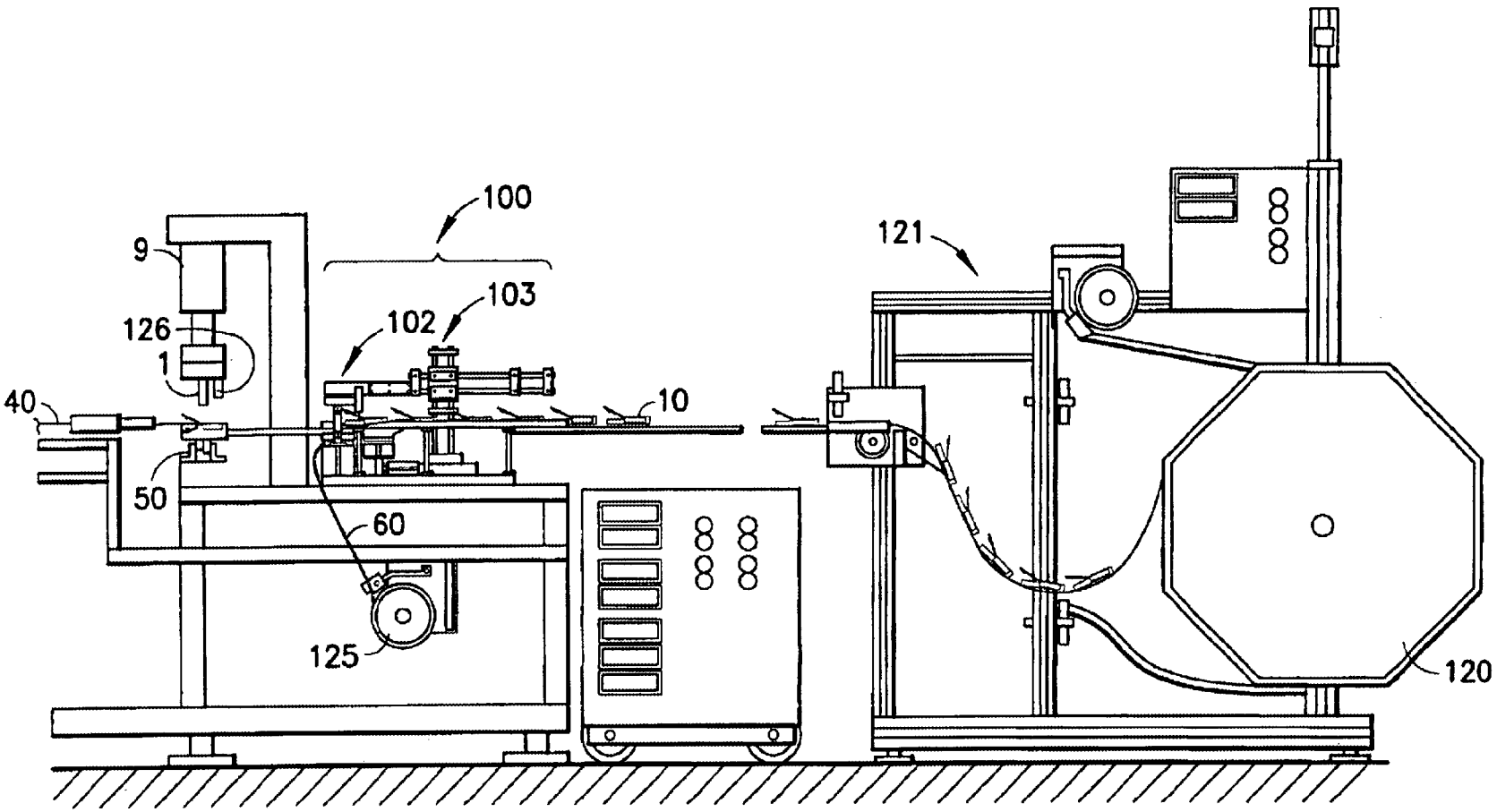
In FIG. 5: a schematic view of a machine for crimping and wiring connectors conforming to the invention.

In order to constitute the crimping device and as visible in FIG. 5, the tool made up of the block forming the machined matrix must be joined to a press 9. For this, the block shown has holes 5, 6, parallel to the two opposite facing surfaces bearing the paving blocks, the holes being arranged in a median plane to these two surfaces so as to be able to use both sides of the block.

These holes take up shafts 7, 8 for holding and guiding the block to join the block with a support that is in turn joined to the position of crimping press 9.

For its attachment, the block can have pieces or rails for holding in the support, the essential point being that the block is precisely guided by the press during the crimping operation.

In addition to a mobile pressing device 9 provided with a block 1 whose surface parallel to the plane of alignment of the contacts has a plurality of crimping matrices made up of paving blocks 3 with polygonal terminal section, the crimping device or post designed for crimping a connector 20 furnished with a plurality of contacts 10, has an anvil 50 forming a lower support surface for electrical contact elements 10. This anvil is more particularly visible in FIG. 6B.

Anvil 50 is designed to be positioned under paddles 13 of contacts 10 when connector modules 20 are brought to the level of the crimping station.

Figure 6A:
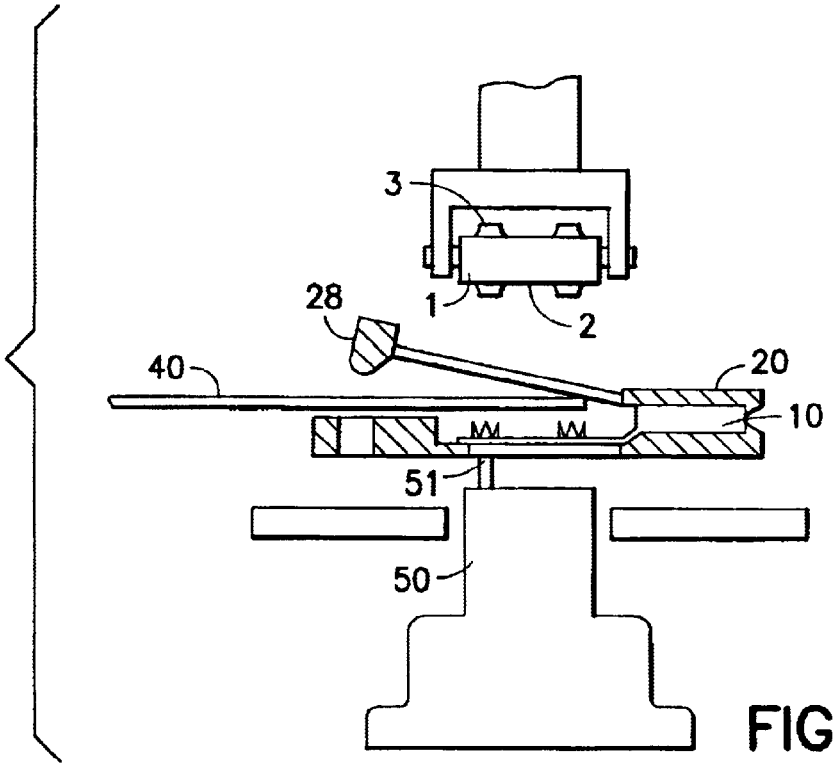
In FIGS. 6A and 6B: an enlarged schematic view of the crimping post according to FIG. 5.
Figure 6B:
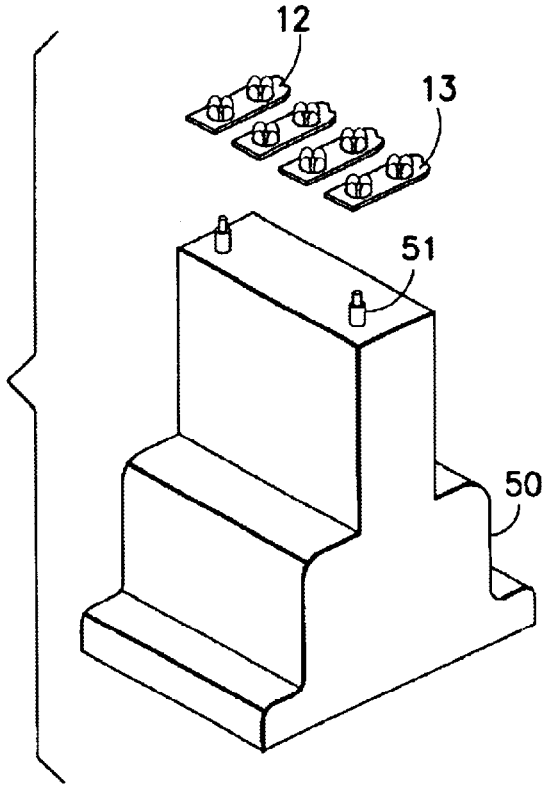

This anvil as described in FIG. 6B has at least one positioning element 51 and advantageously two positioning elements.

For the crimping operation, the connector modules as well as the flexible circuits are moved until anvil 50 is under paddles 13 of contacts 10. The positioning elements are then arranged facing the crowns of two contacts positioned at each end of flexible circuit 40, each positioning element then being introduced into a circular hole of a crown either by vertical movement of the anvil or by vertical movement of the module.

As is visible in FIG. 5, a device 126 for holding the connector module during crimping is also provided, this device being mounted in parallel to the block on press 9.

According to FIG. 6B, the positioning elements have a piston device made up of a tube 52 fitted into the anvil, this tube taking up a shaft 53 mounted in the tube with a spring 54 that permits sliding the shaft into the tube.

Figure 4B:
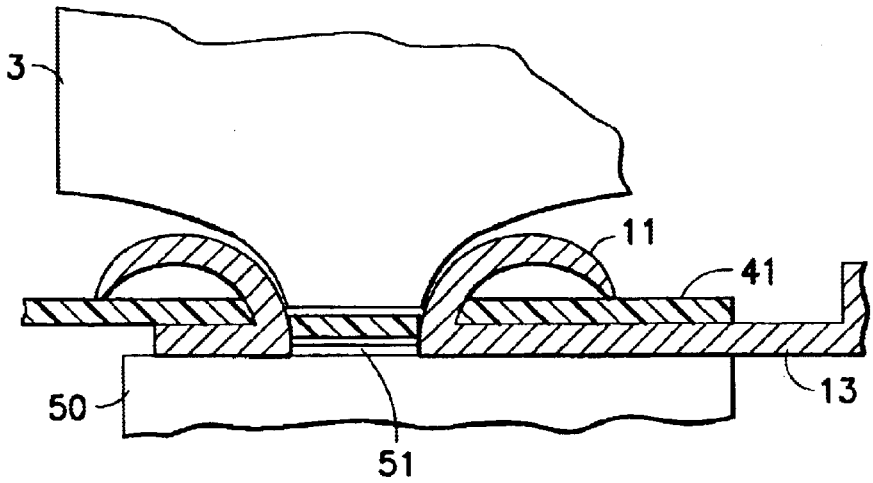
In FIG. 4B: a sectional view of an element for connection by crimping in the process of being crimped.

As shown in FIG. 6A, flexible circuit 40 is then positioned on paddles 13 and the block is applied by the press onto the flexible circuit, each of paving blocks 3 locally and strongly applying flexible circuit 40 onto points 11 so as to pierce the flexible circuit and tracks 41 and then to bend the points which thus come to crimp the paddles onto the flexible circuit and to create the electrical connection between contacts 10 and conductive tracks 41 of the flexible circuit. The crimping operation is visible schematically in FIG. 4B.

During application of the paving blocks forming matrices onto the flexible circuit and then onto the points of the crown, shafts 53 of the positioning device move toward the bottom under the action of the matrices.

One example of a complete automatic crimping station that has a crimping post conforming to the invention is visible in FIG. 5. This station can have an automated intake device 100 for these connectors with their pre-mounted contacts.

The connectors can be positioned by ratcheting onto a bearing belt 60 provided with rollers, a feed device for the crimping station then having a continuous unrolling station 121 of the type known in and of itself.

In the case where the connectors are arranged on a bearing belt 60, the station will have, after the unrolling station, a device 100 for detaching the connectors from the bearing belt and for bringing the connector units toward the crimping post.

Figure 1:
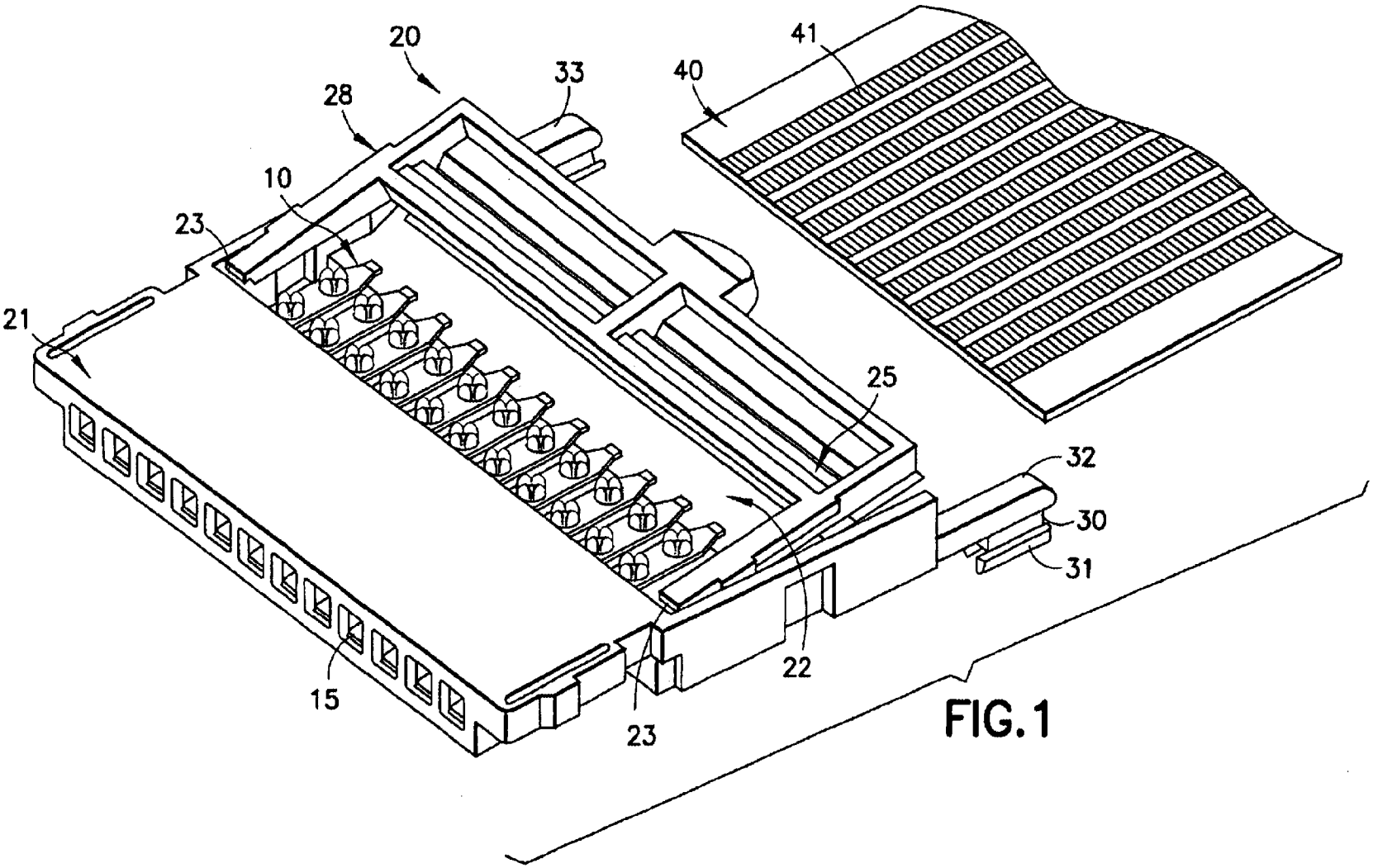
In FIG. 1: an example of the connector module for flexible circuits to which the invention is applicable.

As shown in FIG. 1, the connectors can be provided with a releasing window in the crimping zone and are also provided with a flap 28 for holding the flexible circuit. The flap can have a frame connected by a hinge 23 to the connector housing taking up the contacts.

The frame permits conducting the crimping operation through flap 28, the flap being closed again after the crimping operation, this flap 28 having a rear arm provided with one or more protrusions 25 for supporting and placing the flexible circuit under pressure in order to isolate and protect the crimping zone from possible stresses applied onto the flexible circuit outside the connector.

The paving blocks making up the crimping matrices will be implanted as a function of the number of contacts per connector, the interval between the contacts and the number and the position of the crimping crowns on the contacts. A device for which the paving blocks will have a different section as a function of the diameter of the crowns, of course, is possible, as well as the embodiment of blocks for which the faces bearing the crimping matrices have different configurations to permit changing the matrices according to the configurations of the flexible circuits and the connectors to be crimped.

What is claimed is:

1. A crimping tool for crimping paddles of electrical contacts onto conductive tracks of a flexible circuit, characterized in that the crimping tool has a multipoint network of crimping matrices provided by a solid block of unitary construction and having at least one flat surface on which a network of paving blocks of polygonal section and flared base is formed, the paving blocks making up the matrices, and the tool being adapted for being mounted to a press.

2. The tool according to claim 1, further characterized in that each of the paving blocks has a profile forming on each of their lateral surfaces a curve flaring out from a terminal section of the paving block toward a base of the paving block.

3. The tool according to claim 1, designed for contacts provided with points for crimping arranged in crowns, further characterized in that the polygonal section of each of the paving blocks is oriented in such a way that lateral faces of each of the paving blocks come into contact with crimping points on the electrical contacts during crimping so as to press back the crimping points and make them into petals.

4. The tool according to claim 1, further characterized in that the solid block has rails for holding supports.

5. A crimping tool for crimping paddles of electrical contacts onto conductive tracks of a flexible circuit, characterized in that the crimping tool has a multipoint network of crimping matrices provided by a solid block having at least one flat surface on which a network of paving blocks of polygonal section and flared base is machined, the paving blocks making up the matrices, further characterized in that the solid block has the network of paving blocks disposed on two opposing parallel surfaces of the block.

6. A crimping tool for crimping paddles of electrical contacts onto conductive tracks of a flexible circuit, characterized in that the crimping tool has a multipoint network of crimping matrices provided by a solid block having at least one facing surface on which a network of paving blocks of polygonal section and flared base is machined, the paving blocks making up the matrices, further characterized in that the solid block has holes parallel to the at least one facing surface and another facing surface of the block, in a plane median to the two facing surfaces, the holes receiving shafts for holding and guiding the block, the shafts being joined to the solid block with a support that is in turn joined with a piston of a crimping press.

7. A crimping device for contacts onto a flexible circuit, comprising an anvil forming a lower support surface for electrical contact elements, a mobile pressing device being arranged facing the anvil and provided with a solid block with a surface parallel to a plane of alignment of the contacts, the surface having a plurality of crimping matrices made up of paving blocks each with a terminal polygonal section, wherein the solid block has supports formed on another surface of the solid block for mounting the solid block to a piston of the mobile pressing device, the other surface forming an angle with the surface having a plurality of crimping materials.

8. The device according to claim 7, further characterized in that when the anvil is positioned on paddles of the contact elements, the anvil has at least one positioning element positioned facing a crown of crimping points on the paddles.

9. The device according to claim 8, further characterized in that the at least one positioning element comprises two positioning elements arranged facing the crowns of two contacts positioned at each end of a flexible circuit, each positioning element being introduced into a circular hole of a corresponding one of the crowns.

10. The device according to claim 9, further characterized in that the positioning elements have a piston device made up of a tube fitted into the anvil, this tube taking up a shaft mounted in the tube with a spring permitting the sliding of the shaft in the tube.

11. A crimping post for crimping electrical contacts onto flexible circuits, the contacts and the flexible circuit being taken up in an electrical connector module, characterized in that the crimping post has a crimping device according to claim 7, and in that the connector module has a rear window and a flap for holding the flexible circuit made up of a frame, the solid block being sized to be taken up through the frame and the anvil being sized to be taken up through the window.

* * * * *